US007748891B2

(12) United States Patent
Tysse et al.

(10) Patent No.: US 7,748,891 B2
(45) Date of Patent: Jul. 6, 2010

(54) LIQUID STORAGE TANK WITH DRAFT TUBE MIXING SYSTEM

(75) Inventors: James B. Tysse, Yorkville, IL (US); Greg A. Larson, Ames, IA (US); Donald Neil Ruehrwein, Batavia, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 504 days.

(21) Appl. No.: 11/711,401

(22) Filed: Feb. 27, 2007

(65) Prior Publication Data

US 2008/0203098 A1 Aug. 28, 2008

(51) Int. Cl.
*B01F 5/10* (2006.01)

(52) U.S. Cl. ..... 366/174.1; 366/163.2; 366/167.1

(58) Field of Classification Search ..... 366/101, 366/106–107, 167.1, 174.1, 175.2, 136–137, 366/163.2

See application file for complete search history.

(56) References Cited

U.S. PATENT DOCUMENTS

| | | | | | |
|---|---|---|---|---|---|
| 1,000,689 | A * | 8/1911 | Paterson | ..... | 366/174.1 |
| 1,026,578 | A * | 5/1912 | Hammond | ..... | 366/137 |
| 1,054,629 | A * | 2/1913 | Warwick | ..... | 366/137 |
| 2,131,105 | A * | 9/1938 | Hill | ..... | 366/265 |
| 4,358,206 | A * | 11/1982 | Schutte | ..... | 366/262 |
| 5,735,600 | A * | 4/1998 | Wyness et al. | ..... | 366/174.1 |
| 2008/0203098 | A1 * | 8/2008 | Tysse et al. | | |

FOREIGN PATENT DOCUMENTS

| | | | |
|---|---|---|---|
| JP | 62136295 | A * | 6/1987 |
| JP | 01254295 | A * | 10/1989 |
| JP | 07060283 | A * | 3/1995 |
| JP | 07196393 | A * | 8/1995 |
| JP | 7-308569 | * | 11/1995 |

OTHER PUBLICATIONS

Roberts, Philip J. W. et al.; "Physical Modeling of Mixing in Water Storage Tanks"; Awwa Research Foundation; 2006 (3 pages).

* cited by examiner

*Primary Examiner*—Charles E Cooley
(74) *Attorney, Agent, or Firm*—Osha • Liang LLP

(57) ABSTRACT

A drinking water distribution reservoir has a new draft tube mixing arrangement. An intermediate opening in the draft tube enables water to flow between the central passage of the draft tube and an intermediate portion of the tank. Directional walls can provided on the intermediate opening to help direct flow, and a check valve can be used to prevent flow from the intermediate section of the tank into the draft tube or prevent flow from the draft tube into the intermediate section of the tank. A venturi portion can also be provided on the draft tube to help draw water from the intermediate portion of the tank into the draft tube.

3 Claims, 4 Drawing Sheets

LIQUID STORAGE TANK WITH DRAFT TUBE MIXING SYSTEM

CROSS-REFERENCE TO RELATED APPLICATIONS

Not applicable.

BACKGROUND OF THE INVENTION

This invention relates generally to liquid storage tanks and more particularly to an improved stricture for automatically mixing the contents of a liquid storage tank such as a drinking water distribution reservoir.

Drinking water distribution reservoirs, such as standpipes, ground storage tanks, or elevated tanks, provide a reserve of water that can be used to meet short-term periods of high demand. Water is usually pumped into and drawn out of a lower portion of the reservoir. Although the inflow of water creates some turbulence, the turbulence generally is inadequate to provide significant mixing in the reservoir. Consequently, absent mixing, the last water added to the tank would typically be the first water to be removed.

The water near the top of the reservoir, on the other hand, would typically be the last water to be removed, and thus would be removed only in periods of exceptionally high demand. Because it would be the last water to be removed, it could reside in the reservoir for a long period of time. During that time, disinfectant in the water may dissipate and the water could become stagnant, leading to microbial growth and the production of disinfection byproducts. Stagnant water may contain pathogenic, taste, and odor-forming organisms, and may not meet regulatory requirements.

To avoid this problem, distribution reservoirs are often equipped with mixing systems. However, many conventional mixing systems are relatively expensive to build, maintain, and operate. The CB&I Fresh-Mix system described in U.S. Pat. No. 5,735,600, on the other hand, provides a good, relatively-inexpensive mixing system.

In the Fresh-Mix system, a draft tube is positioned above the inlet to the tank. As water flows into the tank, it enters the lower end of the draft tube, pulling other water from the lower section of the tank with it. The water mixes and exits through the upper end of the draft tube. This movement of water through the draft tube develops a rotational flow pattern in the tank, providing an automatic, relatively-inexpensive, and easily-maintained mixing system.

However, there are circumstances when a simple draft tube arrangement may not provide optimal mixing. When the density of the water entering the tank is significantly different than the density of the water already in the tank, a traditional draft tube arrangement may not provide optimal mixing. If the density of the incoming water is significantly greater than the density of the water already in the tank, in-flowing water may not reach the top of the draft tube, preventing the desired rotational flow pattern from developing. If the density of the incoming water is significantly less than the density of the water already in the tank, the inflow may tend to accumulate at the top of the tank, creating stratification and again impairing the development of the desired flow pattern.

The efficiency of a draft tube system can also be impaired by a reduction in the liquid level in the reservoir. When the liquid level in the reservoir falls below the top of the draft tube, the mixing pathway through the draft tube effectively shuts down and the mixing ends.

Using a relatively short draft tube might reduce the frequency of the liquid level falling below the top of the draft tube, and thus might reduce the frequency of this problem. However, reducing the length of the draft tube also reduces the mixing provided by the draft tube.

It is therefore desirable to provide an alternative mixing arrangement that addresses one or more of these special problems associated with drinking-water reservoirs.

BRIEF SUMMARY

Some of these problems can be addressed by the improved draft tube mixing system that has now been developed. The new arrangement can provide better mixing than past draft tube arrangements in situations when the density of the incoming water differs significantly from the density of the water already in the tank, and in situations when the liquid level in the reservoir varies through a wide range, causing the liquid level to fall below the top of a standard-height draft tube.

Like some prior known drinking-water distribution systems, the new arrangement employs a draft tube that has a central passage that extends between an upper opening in an upper portion of the tank and a lower opening in a lower portion of the tank. The draft tube is positioned so that the reservoir inlet directs liquid into the lower opening of the draft tube. In normal situations, therefore, the momentum of incoming water carries it into the draft tube and automatically establishes a rotational flow pattern in the tank that helps to reduce stagnation.

Unlike prior known arrangements, the new arrangement also has an intermediate opening in the draft tube through which water flows between the central passage of the draft tube and an intermediate portion of the tank. In situations where the level of the tank is relatively low or where the water entering the tank is significantly more dense than the water already in the tank, water rising in the draft tube can flow outwardly through the intermediate opening. In situations where the incoming water is significantly less dense than the water already in the tank, water can enter the draft tube through the intermediate opening. As conditions change, a particular system may perform in one of these manners at some times, and in the other manner at other times.

Specific adaptations in the arrangement can be provided to meet particular needs. For example, in some circumstances, directional walls might be extended from the intermediate opening to help direct flow. A check valve might be mounted on the intermediate opening either to prevent flow from the intermediate section of the tank into the draft tube or prevent flow from the draft tube into the intermediate section of the tank. The intermediate portion of the draft tube might also be provided with a venturi portion to help draw water from the intermediate portion of the tank into the draft tube.

BRIEF DESCRIPTION OF THE DRAWINGS

The invention may be better understood by referring to the accompanying drawings, in which.

DETAILED DESCRIPTION

Figure 1:
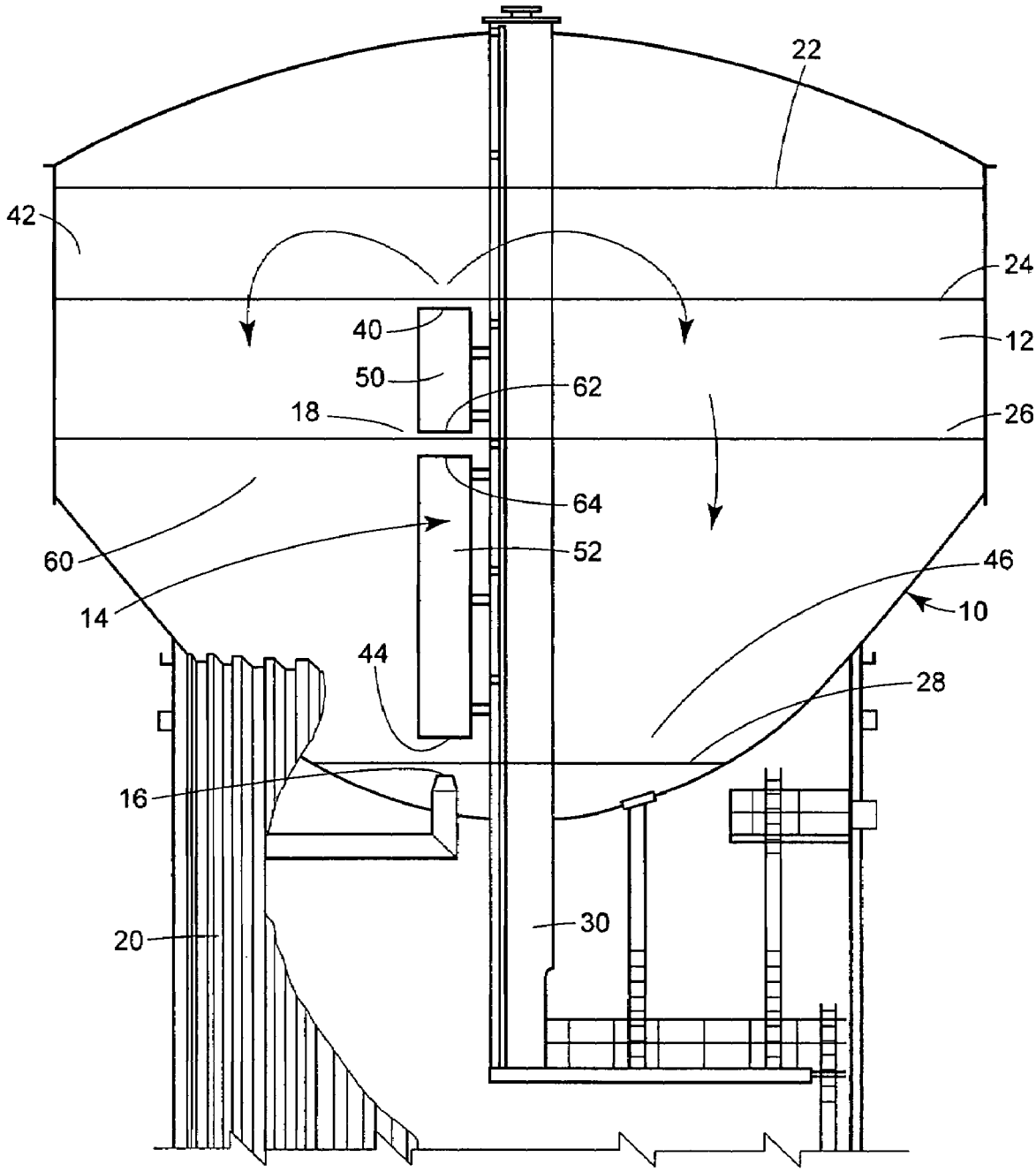
FIG. 1 is a cut-away elevation view of one example of drinking-water distribution reservoir that incorporates the invention.
Figure 2:
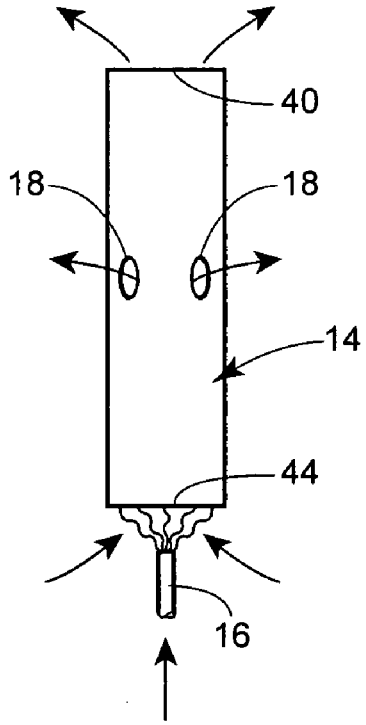
FIGS. 2-11 are elevational views of alternative embodiments of draft tubes that can be used in the reservoir.

The improved drinking-water distribution reservoir 10 seen in FIG. 1 is an example of an arrangement that can provide better mixing than a standard draft tube arrangement in situations where the liquid level in the reservoir falls below the top of a conventional draft tube as well as in situations where the density of the incoming water differs significantly from the density of the water already in the tank.

The principal components of the illustrated drinking-water distribution reservoir 10 are a tank 12, a draft tube 14, a reservoir inlet 16, and an intermediate opening 18 in the draft tube. Each of these components is discussed in more detail below.

The Tank

The illustrated tank 12 is an elevated tank. The tank has an interior storage volume in which, of course, water is stored. The quantity of water stored in the tank varies over time as new water is added or as water is withdrawn for use, and the surface level of the stored water rises and falls as the stored volume of water changes over time. Level 22 is a top capacity level for water stored in the illustrated tank. Levels 24 and 26 are intermediate operating levels for water stored in the tank. Level 28 is a bottom capacity level.

The illustrated tank 12 is a 1.5 million gallon capacity tank that is supported by a wall or support structure 20 that is more than 100 feet high. A central access tube 30 in the illustrated tank extends upwardly though the center of the tank. The top capacity level 22 is at an elevation of approximately 150 feet. The intermediate operating levels 24 and 26 are at elevations of approximately 140 and 130 feet, respectively. The bottom capacity level 28 is at an elevation of approximately 110 feet. These elements and elevations are optional. The invention can also be used in storage tanks of different heights and arrangements, and with other types of drinking-water storage reservoirs, such as standpipes or ground storage tanks.

The Draft Tube and the Reservoir Inlet

The draft tube 14 has a central passage that extends between an upper opening 40 in an upper portion 42 of the tank 12 and a lower opening 44 in a lower portion 46 of the tank. In some situations, it may be preferable for the lower opening to have a cross-sectional area that is less than the cross-sectional area of the upper opening in the draft tube. In the illustrated example, the draft tube has an upper section 50 made of 28" diameter, 9' long pipe, and a lower section 52 made of 24" diameter, 22' long pipe.

The reservoir inlet 16 that is used to add water to the tank (or, in some cases, to withdraw water from it) directs liquid into the lower opening 44 of the draft tube; i.e., the liquid flows directly from the inlet into the lower opening, rather than into the upper portion 42 or an intermediate portion 60 of the tank where it would need to travel around the draft tube before entering the lower opening. In the illustrated examples, the reservoir inlet is spaced from and directed towards the lower opening of the draft-tube 14, so that a straight-line projection from the inlet passes through a portion of the central passage of the draft tube. In the example seen in FIG. 1, the reservoir inlet is beneath and directly below the lower opening of the draft tube. The illustrated inlet is also axially aligned with the lower opening of the draft tube. The inlet could also be extended into the lower end of the draft tube. With the illustrated arrangements, as water is pumped into the tank through the inlet, water stored in the lower portion 46 of the tank will be drawn into the draft tube 14 where it will mix with the newly-added water. To facilitate this mixing, it may be advantageous for the lower opening 44 in the draft tube to have a cross-sectional area that is greater than the cross-sectional area of the reservoir inlet. In the illustrated example, the reservoir inlet is a nozzle with a 12" outlet diameter, and the top of the reservoir inlet is spaced about 2 feet beneath the lower opening 44.

The combined stream of water coming in through the reservoir inlet 16 and entrained water from the lower portion 46 of the tank will generally rise though the draft tube 14. In normal circumstances, the stream will exit out of the upper opening 40 of the draft tube, where it then mixes with the water in the upper portion 42 of the tank. This flow of water into the upper portion of the tank causes water from the upper portion of the tank to circulate back to the lower portion of the tank, as shown by the arrows in FIG. 1.

Although the illustrated draft tube 14 is shown in the center of the tank 12, it can also be positioned to a side of the tank. If the reservoir inlet is positioned on a side of the tank, the draft tube can be formed with a substantially U-shaped plate mounted on the reservoir wall 14. This type of draft tube can reduce construction and maintenance costs because less material is needed to build the draft tube and no additional supporting structure is required.

The Intermediate Opening

The intermediate opening 18 provides an alternative flow path through which water can flow between the central passage of the draft tube 14 and an intermediate portion 60 of the tank. This alternative flow path can be used to address special circumstances that sometimes arise in drinking-water storage reservoirs.

In situations where the level of the tank 12 is relatively low or where the water entering the tank is significantly more dense than the water already in the tank, water rising in the draft tube 14 may not have enough energy to reach the upper opening 40 of the draft tube. A conventional draft-tube arrangement may not provide the desired mixing in these circumstances. The intermediate opening 18 helps solve this problem by providing an alternative path through which water rising in the draft tube can flow outwardly into the main volume of the tank. A circulation path then develops in which water rises up through the draft tube, out the intermediate opening into the intermediate portion 60 of the tank, back down to the lower portion 46 of the tank, then back up through the draft tube.

In situations where the water entering the tank 12 is significantly less dense than the water already in the tank, the mixed water exiting the top of the draft tube 14 may not be sufficiently dense to return all the way back to the lower portion 46 of the tank. The intermediate opening 18 helps solve this problem by providing an alternative path for water to enter the draft tube. A circulation path develops in which water rises up through the draft tube, out of the upper opening, back down to the intermediate portion 60 of the tank, then back into the draft tube through the intermediate opening.

The intermediate opening 18 can take several forms. In the example shown in FIG. 1, the intermediate opening takes the form of an upper aperture 62 on the lower end of the upper section 50 of the draft tube and a lower aperture 64 on the upper end of the lower section 52 of the draft tube. It may sometimes be preferable, as here, for the upper aperture 62 of the intermediate opening to have a cross-sectional area that is greater than the cross-sectional area of the lower aperture 64.

The intermediate opening 18 can also take the form of apertures in the wall of a continuous draft tube, as seen in FIGS. 2-6.

Figure 3:
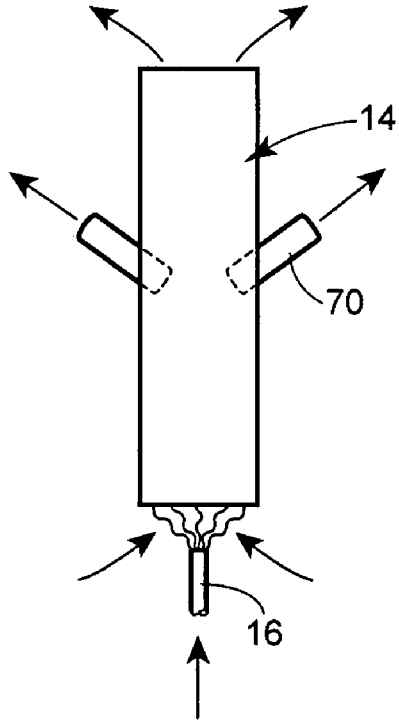
Figure 4:
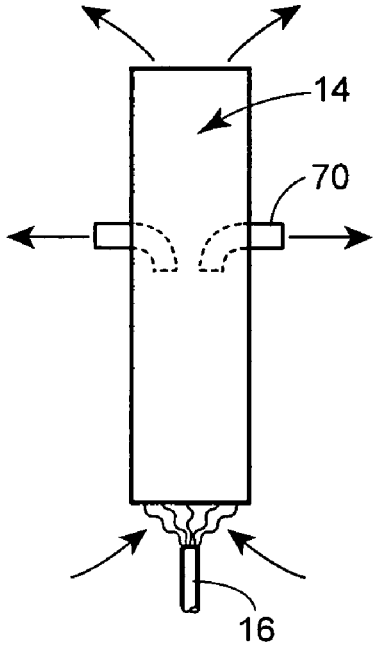
Figure 5:
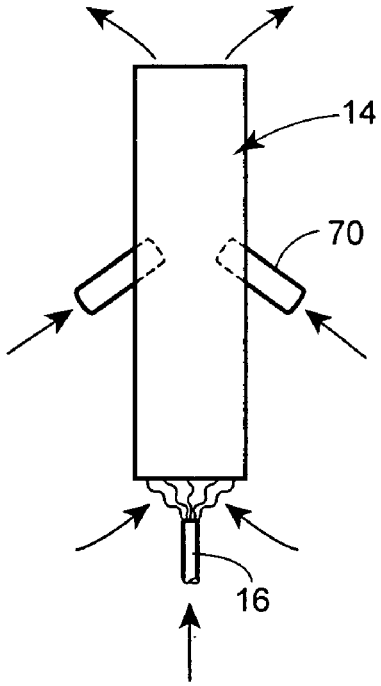

In some circumstances, directional walls can be used in conjunction with the intermediate opening 18. In the examples seen in FIGS. 3-5, directional walls 70 extend from multiple intermediate openings 18. The directional walls can take the form of pipe sections, and can be either straight (as seen in FIG. 3) or bent (as seen in FIG. 4) The directional walls can extend from the opening into the central passage of the draft tube 14, or from the opening into the intermediate portion 60 of the tank, or in both directions. In the examples seen in FIGS. 3 and 4, the directional walls extend downwardly into the central passage of the draft tube. In the example seen in FIG. 3, they also extend upwardly into the intermediate portion of the tank. In the example seen in FIG. 5, the directional walls extend upwardly into the central passage and downwardly into the intermediate portion of the tank.

Figure 6:
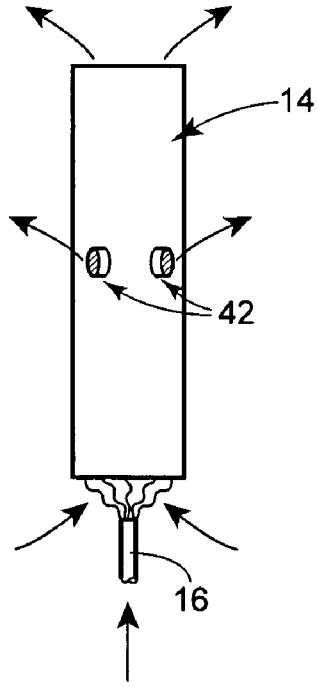

An optional check valve 72 can also be mounted on the intermediate opening 18, as seen in FIG. 6. In some arrangements, such as the one seen in FIG. 6, the check valve may be set to prevent water from flowing into the central passage of the draft tube 14. In other arrangements, the check valve may be set to prevent water from flowing out from the central passage of the draft tube. In some arrangements, remotely-operable valves can be provided so that an operator has discretion to set a direction of flow through the intermediate opening.

Figure 7:
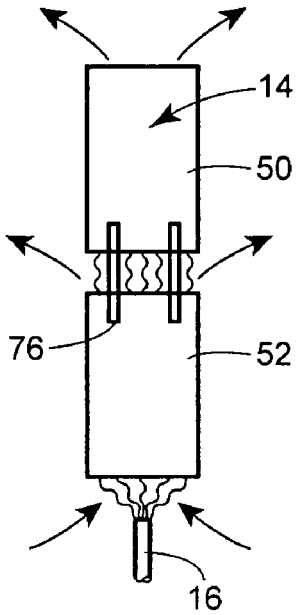
Figure 8:
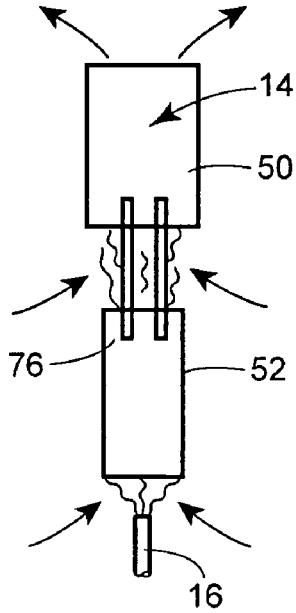
Figure 9:
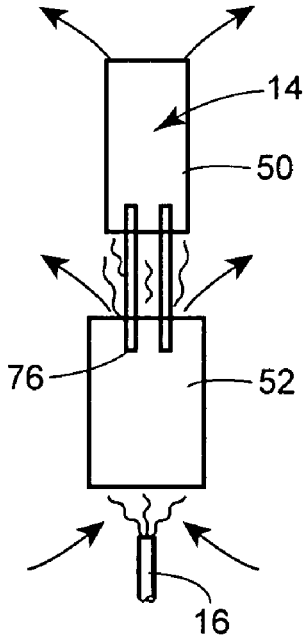

As seen in FIGS. 7-9, the upper section 50 and lower section 52 of the draft tube 14 can each be made of a separate pipe section, with connectors 76 joining the two sections together. A variety of materials, such as narrow steel plates or channels, can be used as connectors. In the example seen in FIG. 7, the pipe sections used for the upper section and for the lower section of the draft tube both have the same diameter. In the example seen in FIG. 8, the pipe section used for the upper section has a larger diameter than the pipe section used for the lower section. This facilities the flow of water from the intermediate portion 60 of the tank through the intermediate opening 18 and into the draft tube. In the example seen in FIG. 9, the pipe section used for the upper section of the draft tube has a smaller diameter than the pipe section used for the lower section. This facilitates the flow of water from the draft tube through the intermediate opening and into the intermediate portion of the tank.

Figure 10:
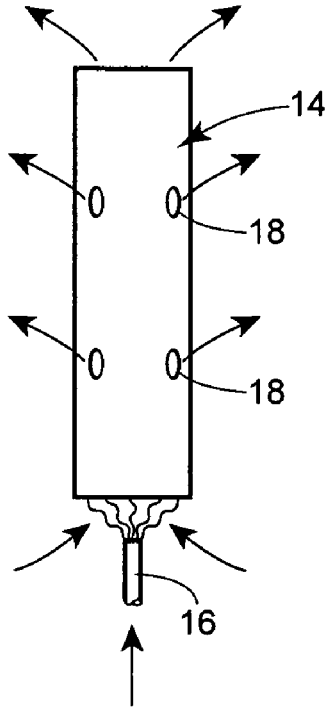

As seen in FIG. 10, more than one set of intermediate openings can be provided. In the illustrated example, there are two rows of intermediate openings 18, each at a different level of the draft tube 14.

Figure 11:
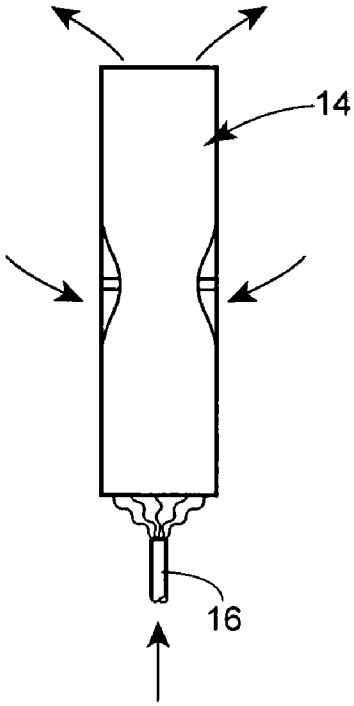

The intermediate opening 18 can also be positioned on a venturi portion of the draft tube 14, as seen in FIG. 11. This arrangement may help to draw water from the intermediate portion 60 of the tank into the draft tube.

Other Options

In some situations, recycling pumps or gas lifters can be added to the arrangement to mix water from the lower portion 46 of the tank with water in the upper portion 42 of the tank. Additional inlets and draft tubes might also be added to obtain more mixing. However, as more draft tubes are added, the expense of building and maintaining the reservoir rises.

This description of various embodiments of the invention has been provided for illustrative purposes. The invention can also be used with other liquids and in other types of storage tanks without departing from the invention. The full scope of the invention is set forth in the following claims.

The invention claimed is:

1. A drinking-water distribution reservoir comprising:

a tank that has an interior storage volume in which varying quantities of water is stored, the stored water having a surface level that rises and falls as the stored volume of water changes over time;

a draft tube that has a central passage that extends between an upper opening in an upper portion of the tank and a lower opening in a lower portion of the tank;

a reservoir inlet that directs water into the lower opening of the draft tube; and at least one intermediate opening in the draft tube through which water flows outwardly from the draft tube when the surface of stored water is below the upper opening, wherein directional walls extend from the intermediate opening, and wherein the directional walls extend from the at least one intermediate opening into the central passage of the draft tube.

2. A drinking-water distribution reservoir comprising:

a tank that has an interior storage volume in which varying quantities of water is stored, the stored water having a surface level that rises and falls as the stored volume of water changes over time;

a draft tube that has a central passage that extends between an upper opening in an upper portion of the tank and a lower opening in a lower portion of the tank;

a reservoir inlet that directs water into the lower opening of the draft tube; and at least one intermediate opening in the draft tube through which water flows outwardly from the draft tube when the surface of stored water is below the upper opening, wherein directional walls extend from the intermediate opening, and wherein the directional walls extend downwardly into the central passage.

3. A drinking-water distribution reservoir comprising:

a tank that has an interior storage volume in which varying quantities of water is stored, the stored water having a surface level that rises and falls as the stored volume of water changes over time;

a draft tube that has a central passage that extends between an upper opening in an upper portion of the tank and a lower opening in a lower portion of the tank;

a reservoir inlet that directs water into the lower opening of the draft tube; and at least one intermediate opening in the draft tube through which water flows outwardly from the draft tube when the surface of stored water is below the upper opening, wherein directional walls extend from the intermediate opening, and wherein the directional walls extend upwardly into the central passage.

* * * * *